US008251837B2

(12) United States Patent
Alan et al.

(10) Patent No.: US 8,251,837 B2
(45) Date of Patent: Aug. 28, 2012

(54) FLOATING GOLF BALL

(75) Inventors: Mark Alan, Portland, OR (US); Jennifer R. Mahalingappa, Bethesda, MD (US)

(73) Assignee: NIKE, Inc., Beaverton, OR (US)

( * ) Notice: Subject to any disclaimer, the term of this patent is extended or adjusted under 35 U.S.C. 154(b) by 199 days.

(21) Appl. No.: 12/854,795

(22) Filed: Aug. 11, 2010

(65) Prior Publication Data

US 2012/0040774 A1 Feb. 16, 2012

(51) Int. Cl.
*A63B 37/02* (2006.01)
*A63B 39/00* (2006.01)
*G01N 1/10* (2006.01)

(52) U.S. Cl. ..... 473/352; 473/355

(58) Field of Classification Search ..... None
See application file for complete search history.

(56) References Cited

U.S. PATENT DOCUMENTS 3,706,140 A * 12/1972 Brillaud et al. ..... 34/60
4,564,199 A * 1/1986 Adams ..... 473/200
5,356,149 A 10/1994 Kane
5,842,936 A 12/1998 Mast
5,886,635 A 3/1999 Landa et al.
5,931,747 A 8/1999 Mast
5,984,806 A 11/1999 Sullivan et al.
6,383,519 B1 5/2002 Sapieszko et al.
6,458,162 B1 10/2002 Koblish et al.
6,521,246 B2 2/2003 Sapieszko et al.
6,800,041 B2 10/2004 Fushihara
6,863,899 B2 3/2005 Koblish et al.
6,991,803 B2 1/2006 Sapieszko et al.
7,223,182 B2 5/2007 Fushihara
7,264,559 B2 9/2007 Ohama et al.
7,294,069 B2 11/2007 Isogawa et al.
7,320,275 B2 * 1/2008 Jenkins et al. ..... 99/345
7,390,542 B2 6/2008 Ohama et al.
7,427,243 B2 9/2008 Sullivan
7,431,969 B2 10/2008 Gleason et al.
2001/0039414 A1 * 11/2001 Brines et al. ..... 604/890.1
2002/0094885 A1 7/2002 Finkel
2002/0107470 A1 * 8/2002 Richards et al. ..... 604/20
2003/0114254 A1 6/2003 Emalfarb
2003/0148825 A1 8/2003 Go (Continued)

FOREIGN PATENT DOCUMENTS

EP 878190 A1 * 11/1998

(Continued)

OTHER PUBLICATIONS

European Search Report for European Patent Application No. EP11176877.6, mailed on Jan. 25, 2012.

*Primary Examiner* — Gene Kim
*Assistant Examiner* — John E Simms, Jr.
(74) *Attorney, Agent, or Firm* — Plumsea Law Group, LLC

(57) ABSTRACT

A golf ball includes an inner layer, a cover layer, and a cavity. The cavity includes a conduit connecting the cavity with an exterior of the golf ball. The cavity contains a matrix comprising particles of a first material bound together by a second material. The first material has a density greater than water and the second material is water soluble. Upon prolonged submersion in water, the matrix dissolves allowing the first material particles to exit the cavity. The removal of the mass of the first material particles lowers the density of the golf ball, allowing the golf ball to float to the surface of the water.

19 Claims, 10 Drawing Sheets

U.S. PATENT DOCUMENTS

2003/0211440 A1* 11/2003 Kuo et al. ..... 433/6
2004/0005360 A1* 1/2004 Wang et al. ..... 424/473
2004/0209701 A1 10/2004 Finkel
2004/0248320 A1* 12/2004 Santini et al. ..... 436/174
2006/0276265 A1 12/2006 Sullivan
2007/0213143 A1 9/2007 Chinn et al.
2008/0236843 A1 10/2008 Scott et al.
2009/0214838 A1 8/2009 Lussem et al.

FOREIGN PATENT DOCUMENTS

EP 2226356 A1 9/2010

* cited by examiner

FLOATING GOLF BALL

BACKGROUND

In the game of golf, players use a club to strike a golf ball towards a hole in the ground. Often the hole is surrounded by hazards, including water hazards such as ponds, lakes, and even the ocean. Golf balls that enter the water hazards typically sink because regulation golf balls are denser than water. Retrieving golf balls that have sunk into the water hazards is difficult, and golf balls left in the bodies of water may pose an environmental risk. It would be advantageous to provide a golf ball that can be easily retrieved from a water hazard.

SUMMARY

The golf ball of the present disclosure is designed to change mass after prolonged submersion in water. The change in mass allows the golf ball to float to the surface of the water hazard after being submerged. The loss of mass is typically achieved by providing pockets within the golf ball containing dense material. The dense material is held within the pockets by water soluble material. When the water soluble material is dissolved when the golf ball is submerged in water, the buoyancy of the golf ball changes from negative to positive, this allowing the golf ball to float to the surface.

In an exemplary embodiment, a golf ball includes an inner layer, a cover layer, and a cavity. The cavity includes a conduit connecting the cavity with an exterior of the golf ball. The cavity contains a matrix comprising particles of a first material bound together by a second material. The first material has a density greater than water and the second material is water-soluble.

In another exemplary embodiment, a golf ball may include a cover layer and at least one cavity. The cavity includes a channel connecting the cavity with an exterior of the golf ball. The channel includes a plug configured to prevent material from entering or exiting the cavity. The cavity contains a plurality of pellets of a first material. The plug is made of a water-soluble material.

In a further exemplary embodiment, a golf ball includes a cover layer and at least one chamber extending from an opening in the cover layer into an inner portion of the golf ball. The golf ball has an initial mass. The golf ball is configured to transition to a second mass when submerged in water for longer than a predetermined period of time.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The embodiments described herein disclose a golf ball configured to lose a portion of its mass when the golf ball is submerged, typically in water, for a pre-determined length of time. The golf ball originally is negatively buoyant, i.e., the golf ball will sink in water. The loss of mass is generally achieved by constructing the balls so that water erodes a first material of the golf ball so that a second material can flow out and away from the golf ball. The second material is denser than water, so as the relatively dense material is replaced by water, the golf ball eventually becomes positively buoyant in the water so that the golf ball floats to the surface for easy retrieval.

Figure 1:
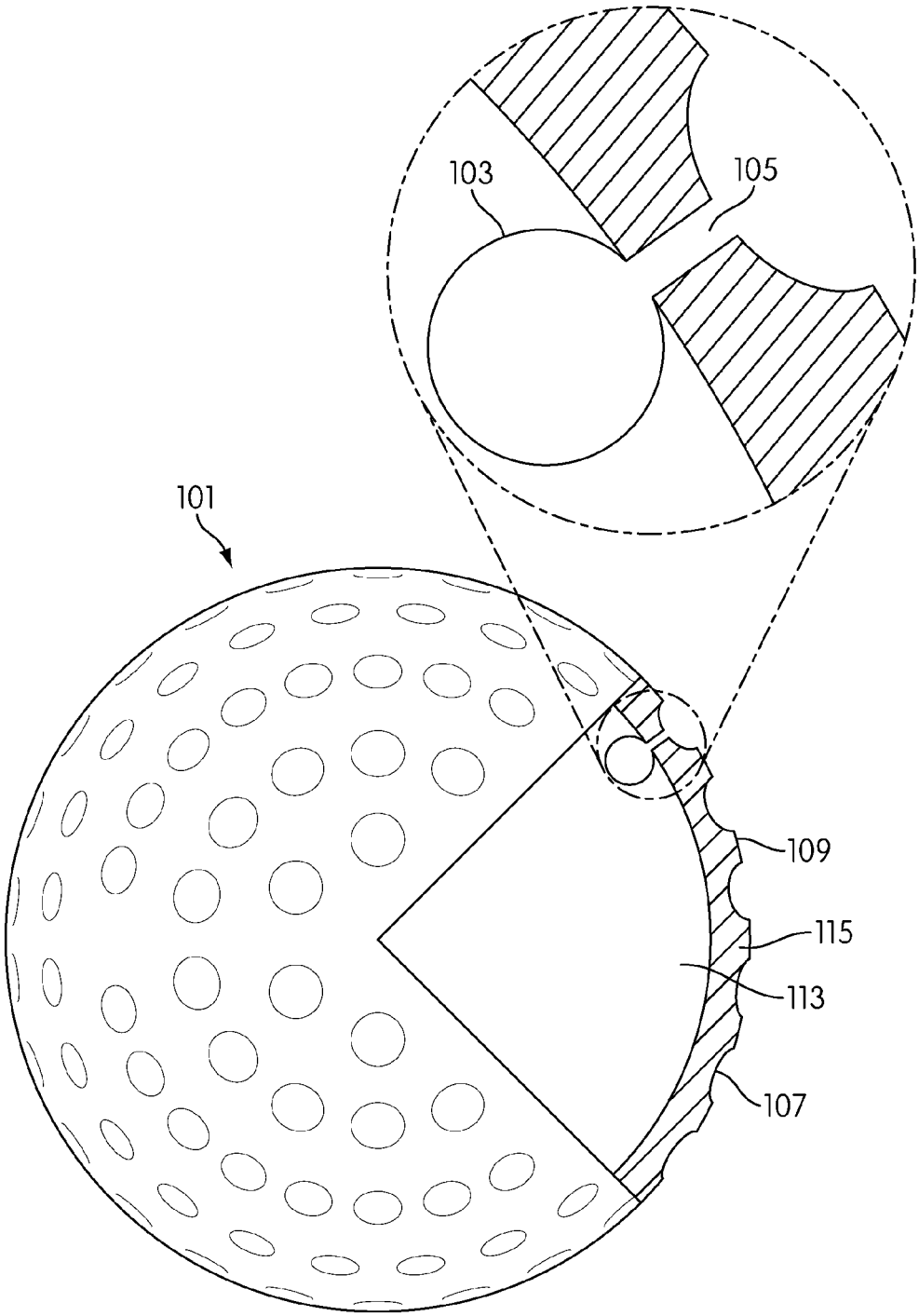
FIG. 1 is an exploded core view of an embodiment of a golf ball including a cavity.

FIG. 1 shows a cross-sectional view of one-quarter of an embodiment of a golf ball 101 configured to alter its mass over time when submerged. Though discussed herein with respect to submersion in water, it is contemplated that golf ball 101 could be readily and easily designed to alter its mass when submerged in any type of liquid or when exposed to certain gases. Golf ball 101 may be substantially spherical and may have a surface having a plurality of dimples 107.

Golf ball 101 may be any type of golf ball known in the art: a one-piece ball including a solid sphere of a single material or a multi-piece ball which may comprise multiple layers. Golf ball 101 may generally include a cover 115 surrounding an inner portion 113.

As used herein, the term "cover" or "cover layer" may be understood as the outermost structural layers of a golf ball, not including any relatively thin finishing layers. Cover 115 may include multiple sub-layers, such as inner cover layers or mantle layers in some embodiments. Cover 115 may be made of any material and have any configuration known in the art. Typical examples of materials for cover 115 include ionomers, rubber, balata, urethanes, and combinations of these materials in addition to other types of materials.

Cover 115 may include dimples 107 surrounded by frets or land 109. Land 109 is the portion of cover 115 which may be considered to provide the greatest diameter for golf ball 101. Dimples 107 are any indentation or protrusion provided on golf ball 101 to improve or affect the aerodynamic performance of golf ball 101. Dimples 107 may have multiple shapes and properties. In some embodiments, dimples 107 may be a regular geometric shape. In some embodiments, dimples 107 may have circular perimeters and define hemispherical indentations in cover 115.

Typically, inner portion 113 provides at least a core. Other layers, such as inner core layers, outer core layers, mantle layers, and inner cover layers may also be considered to comprise inner portion 113. Inner portion 113 may be made from any material or materials known in the art. Typical materials for inner portion 113 include but are not limited to natural and synthetic rubbers and rubber compositions, particularly polybutadiene rubber, ionomers, urethanes, polyurethanes, polymers, particularly highly neutralized polymers, thermoset and thermoplastic materials, metals for fillers, adhesive materials for bonding together different layers of inner portion 113, such as ethylene vinyl acetate (EVA), and combinations of these materials.

Additional layers, such as finishing layers like coatings, paint, printing layers, marking layers, and the like may also be included, such as on an outer surface of cover 115 (not shown).

Figure 2:
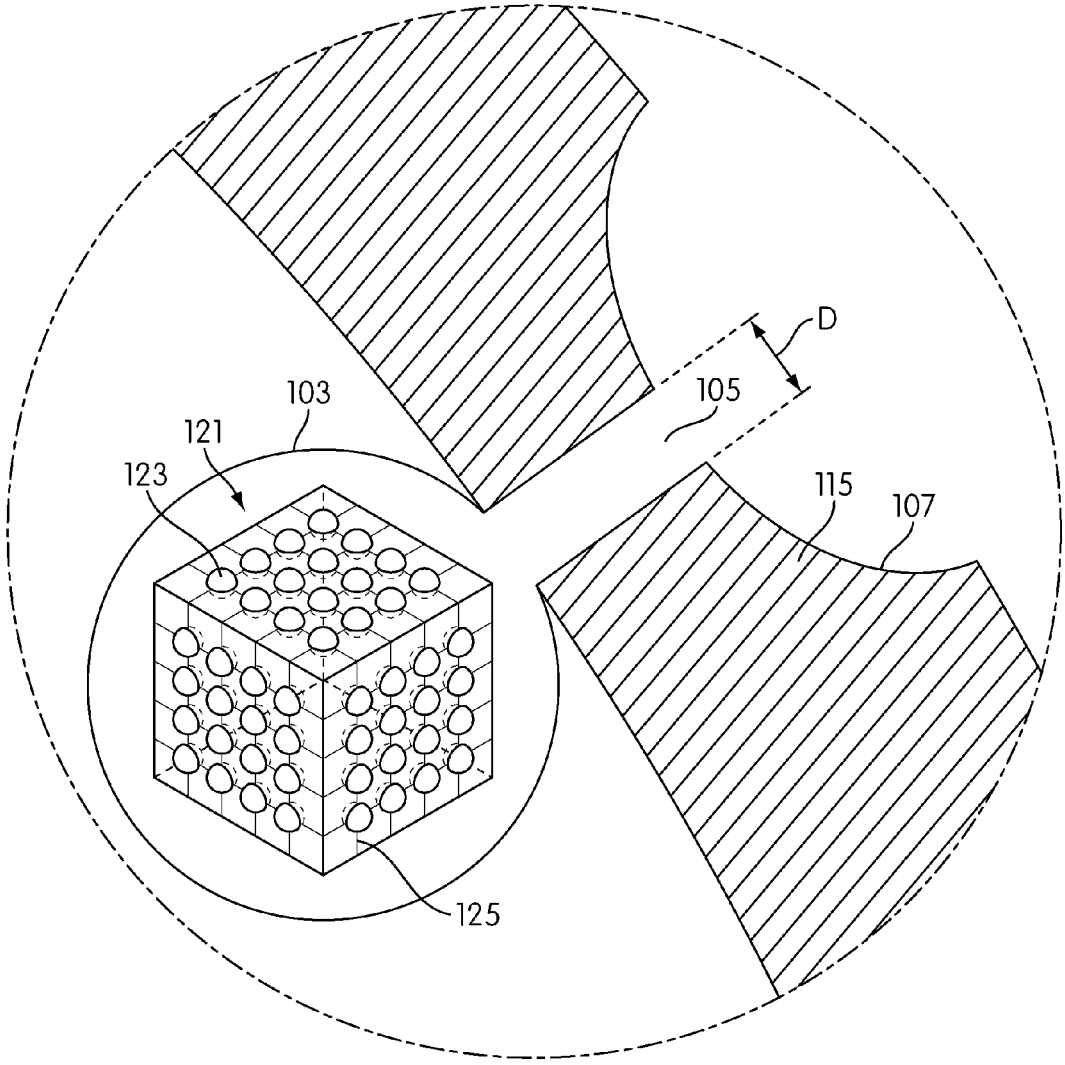
FIG. 2 is an exploded cross-section shot of a cavity in an embodiment of a golf ball.

Golf ball 101 is configured to lose mass when submerged. In some embodiments, golf ball 101 includes provisions for facilitating the loss of mass. In the embodiments shown in the figures, these provisions may include one or more cavities 103. FIG. 2 shows an enlarged portion of golf ball 101 including cavity 103. Cavity 103 may be a hollow space, void, depression, indentation, or the like within an interior of golf ball 101 or in cover layer 115 which is connected to the outer surface of golf ball 101 by a conduit 105. Cavity 103 is configured to contain a quantity of removable material, and conduit 105 is configured to permit the egress of at least a portion of the quantity of removable material to the environment surrounding golf ball 101.

Cavity 103 may be of any size and shape. In some embodiments, cavity 103 may be an irregularly shaped void space within golf ball 101. As shown, however, cavity 103 is a substantially spherical chamber within golf ball 101. While shown to be relatively small in diameter compared to the diameter of golf ball 101, cavity 103 may have substantially larger diameters in other embodiments. Altering the size of cavity 103, i.e., altering the volume of cavity 103, will allow a designer an easy way to vary the amount of removable material held within cavity 103. Therefore, if a designer wishes to use denser materials for the layers of golf ball 101, the designer may provide larger volume cavities 103 so that more material may be removed from golf ball 101 to allow the post-removal golf ball 101 to be positively buoyant in water and/or salt water.

Alternatively, the number of cavities 103 provided may be altered to vary the total volume of removable material provided in golf ball 101. While the figures show only one exemplary cavity 103, multiple cavities 103 may be provided at various locations in golf ball 101. In some embodiments where multiple cavities 103 are provided, cavities 103 may be evenly spaced around the perimeter of golf ball 101. In some embodiments where multiple cavities 103 are provided, an even number of cavities 103 are provided. In other embodiments where multiple cavities are provided, an odd number of cavities are provided. In some embodiments where multiple cavities 103 are provided, two, three, or more cavities may be provided.

In some embodiments, the number of cavities 103 may be altered as opposed to the size of cavities 103 so that certain desirable performance characteristics of golf ball 101 may be achieved. In some embodiments, the size of cavities 103 may be altered as opposed to the number of cavities 103 so that certain desirable performance characteristics of golf ball 101 may be achieved. In other embodiments, both the size and number of cavities 103 may be selected so that certain desirable performance characteristics of golf ball 101 may be achieved.

Cavity 103 is a void or hollow space provided in an interior portion of golf ball 101. In some embodiments, such as in the embodiment shown in FIG. 2, cavity 103 is provided in inner portion 113. In such embodiments, cavity 103 may be provided in any layer or part of inner portion 113, such as in a mantle layer, a core layer, an inner core layer, an outer core layer, and combinations of these layers. In other embodiments, not shown, cavity 103 may be provided in cover 115. In other embodiments, not shown, cavity 103 may extend from cover 115 into inner portion 113. An outermost surface of golf ball 101 may be defined by cover 115 and/or any coating or other similar layers disposed on cover 115, so cavity 103 may be considered to be disposed beneath the outermost surface of golf ball 101.

Cavity 103 may include one or more conduits 105 connecting cavity 103 to the outermost surface of golf ball 101. An aperture or mouth of conduit 105 may be formed in or through the outermost surface of golf ball 101. In other words, conduit 105 provides a bore from cavity 103 to the outermost surface of golf ball 101 so that the aperture or mouth of conduit 105 can control the ingress and egress of material into and out of cavity 103. In some embodiments, cavity 103 may include a single conduit 105. In other embodiments, cavity 103 may include multiple conduits 105. The number of conduits 105 may be chosen based on desired flow properties out of cavity 103. FIG. 2 shows cavity 103 with a single conduit 105. In yet other embodiments, cavity 103 and conduit 105 may be merged so that a single bore contains the dense removable material which causes golf ball 101 initially to have negative buoyancy in water.

Conduit 105 may be of numerous shapes and sizes. In some embodiments, conduit 105 is a passage extending through cover 115. Alternatively, conduit 105 may be an opening or hole in cover 115, particularly if cavity 103 is positioned near to the outermost surface of golf ball 101. Conduit 105 is configured to connect cavity 103, which lies within the interior of golf ball 101, with the outermost surface of golf ball 101 so that the removable material in cavity 103 may be released from golf ball 101 and into the environment surrounding golf ball 101. Conduit 105 may serve as an inlet and outlet for materials to move between cavity 103 and the environment surrounding golf ball 101.

Conduit 105 has dimensions, such as a diameter or width. FIG. 2 shows conduit 105 having a diameter D. Conduit diameter D may be selected to control flow of materials moving between cavity 103 and the exterior of golf ball 101. For example, objects larger than conduit diameter D may not be able to enter or exit cavity 103. Thus, conduit diameter D may be selected to prevent objects larger than a predetermined size from entering or exiting cavity 103.

As shown in FIG. 2, conduit 105 is a narrow passageway through cover 115. In other embodiments, conduit 105 may have other configurations. However, in those embodiments where conduit 105 is a narrow passageway, the size and dimensions of conduit 105 may be used to control the movement of material through conduit 105. For example, when any of the dimensions of the particles of the dense removable material are larger than the largest dimension of conduit 105, the geometry of conduit 105 blocks the movement of the dense removable material through conduit 105.

Conduit 105 may terminate or have a termination point at any location of the outermost surface of golf ball 101. The terms "terminate" and "termination point" used here refer to where the aperture or mouth of conduit 105 breaks through cover 115 and any coating or other layers to provide a path from cavity 103 to the environment surrounding golf ball 101. As shown, conduit 105 terminates within dimple 107. Positioning the termination point within dimple 107 may help to prevent unintentional opening of conduit 105, as the material blocking or plugging conduit 105 may be more brittle than the material of cover 115. Typically, the bottom of dimple 107 deforms less than the material of land 109 when golf ball 101 is struck by a golf club. Therefore, less strain may be placed on the material blocking or plugging conduit 105 if the termination point of conduit 105 is placed in the bottom of dimple 107. However, in other embodiments, the termination point may be in dimple 107, on land 109, or combinations of dimple 107 and land 109 locations, even for the same termination point.

Figure 3:
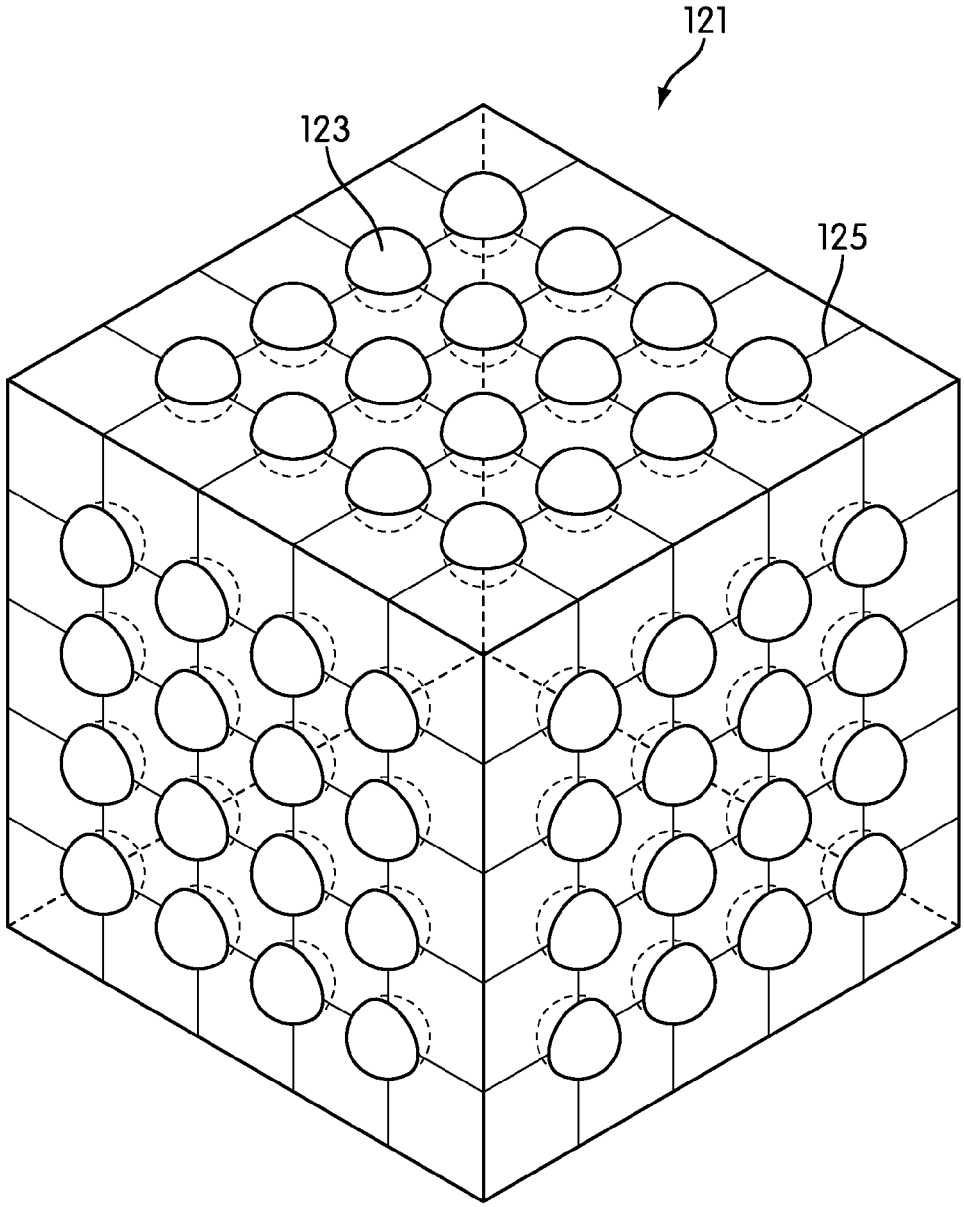
FIG. 3 is an isometric view of a matrix of particles of a first material bound together by a second material.

Cavity 103 may contain one or more composites 121. Composites 121 may comprise particles of a first material 123 bound together by a water-soluble second material 125. FIG. 3 shows an embodiment of composite 121. Though shown as a cube, composite 121 may have any size or shape. Composite 121 may include a longest dimension, such as a leg length, a diameter, or the like. The longest dimension may be considered the longest composite dimension, where the longest composite dimension controls the ability of composite 121 to move within cavity 103, conduit 105, and/or through the conduit aperture or mouth.

First material particles 123 may by any suitable material having a density greater than water. For example, appropriate materials may include but are not limited to glass, sand, other ecologically friendly materials (e.g., materials having substantially no, minimal, or limited negative impact on the surrounding environment), other ecologically inert materials (e.g., materials having no ability to interact with the surrounding environment), and/or combinations of these materials. First material particles 123 may be of any shape or configuration. As shown in FIGS. 2-3, first material particles 123 are spherical pellets of material. However, in other embodiments, first material particles 123 may be pellets having any regular or irregular shape, such as cylindrical, spheroid, uneven, polygonal, powdered, and/or combinations of these shapes. First material particles 123 may have a diameter or width smaller than conduit diameter D.

First material particles 123 provide the bulk of the mass to composite 121. When composites 121 are placed in cavity 103, the mass of golf ball 101 may be increased, sometimes significantly, for example, if extremely dense materials as compared to water are used for first material particles 123. The mass of golf ball 101 may thus be varied by the addition and removal of first material particles from cavity 103. This variation in mass may be sufficient to alter the buoyancy of golf ball 101 from negative, so that golf ball 101 tends to sink, to positive, so that golf ball 101 tends to float. Another advantage to having a denser-than-water material positioned proximate cover 115 is to increase the moment of inertia of golf ball 101 by shifting mass toward cover 115.

Second material 125 may be any suitable water-soluble bonding material. Second material 125 may be a water-soluble epoxy, salts, starch-based binders, various polymers such as depart, and/or other types of water soluble materials. Second material 125 may bond together first material particles 123 into composite 121. In addition to being water soluble, second material 125 may include particles which bubble or fizz when the particles react with water. For example, second material 125 may include particles of sodium bicarbonate and citric acid along with more robust water soluble materials. The sodium bicarbonate dissociates into sodium ($Na^+$) and bicarbonate ($HCO_3^-$) ions in water. The bicarbonate reacts with hydrogen ions ($H^+$) from the citric acid to form carbon dioxide and water. The carbon dioxide forms bubbles. This fizzing or bubbling action may assist in expelling first material 123 from cavity 103 when golf ball 101 is submerged in water.

In some embodiments, composite 121 may fill the entirety of cavity 103. In other embodiments, composite 121 may only partly fill cavity 103. In other embodiments, composite 121 may loosely reside within cavity 103 so that water may completely surround composite 121 when golf ball 101 is submerged. Composite 121 may be configured to fill the entire cavity 103 to prevent movement of composite 121 during a use of golf ball 101.

Golf ball 101 may have an initial state where cavity 103 contains an initial amount of composite 121 and conduits 105 are blocked. Golf ball 101 has various initial properties associated with this initial state, including an initial mass, an initial density, and an initial number or amount of composites 121 located within cavity 103. The number of composites 121 located within cavity 103 may be chosen so that the initial mass and the initial density of golf ball 101 are a regulation mass and a regulation density for golf balls. The number of composites 121 may also be selected so that when a predetermined percentage of the composites 121 are removed from golf ball 101, the buoyancy of golf ball 101 shifts from negative buoyancy to positive buoyancy. In some embodiments, cavity 103 may include a single composite 121 and the amount of first material particles 123 within composite 121 may be chosen so that the initial mass and the initial density of golf ball 101 are the regulation mass and the regulation density for golf balls. Similarly, the amount of first material particles 123 within composites 121 may also be selected so that when a predetermined percentage of first material particles 123 are removed from golf ball 101, the buoyancy of golf ball 101 shifts from negative buoyancy to positive buoyancy.

The operation of the embodiment of golf ball 101 in use will now be explained using FIGS. 4-7. During play, golf ball 101 may be struck into a body of water 131. Body of water 131 contains water 133.

Figure 4:
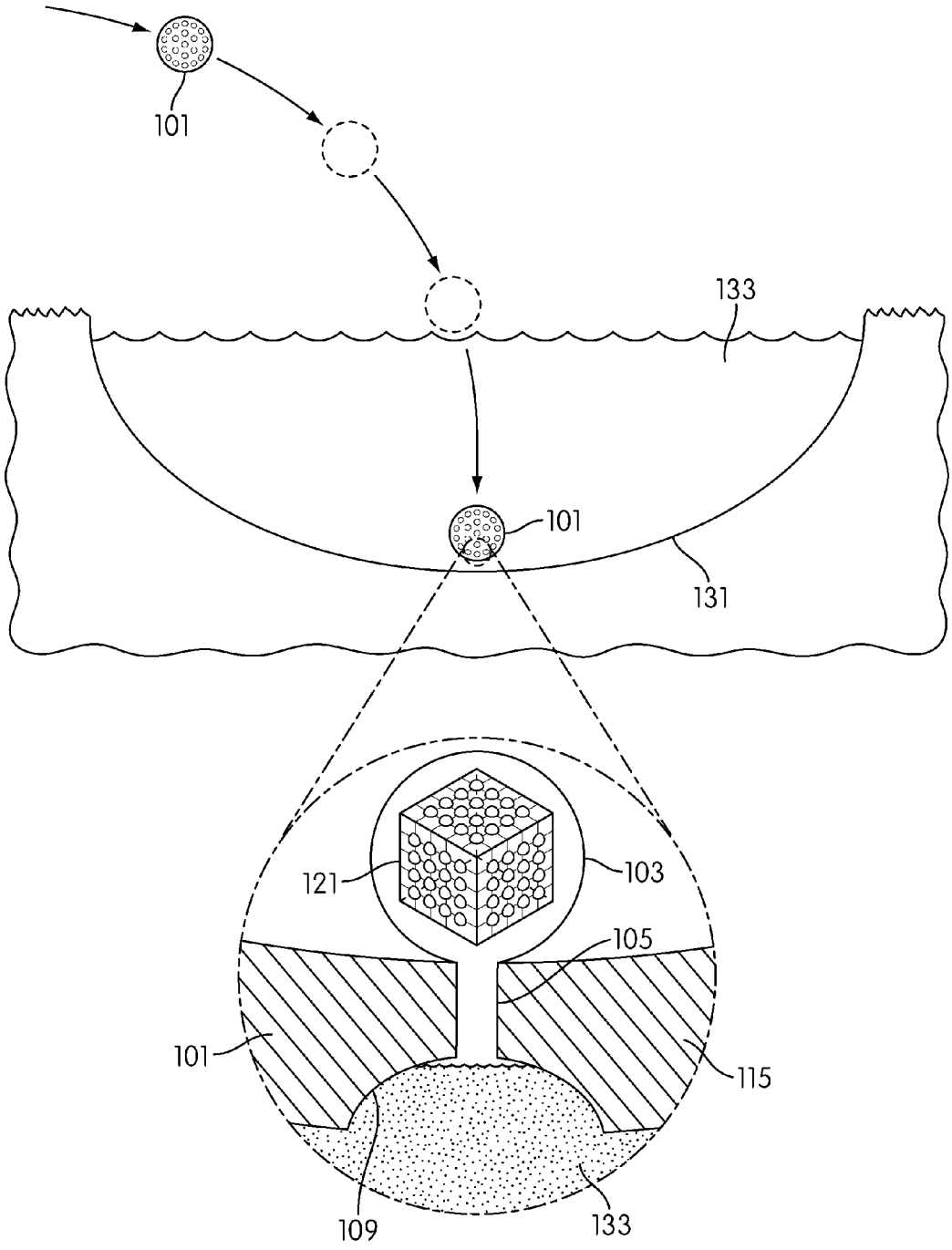
FIG. 4 shows a cavity of a golf ball immediately after submersion in a water hazard.

The initial density of golf ball 101 may be configured to be greater than water 133. In other words, golf ball 101 will be negatively buoyant in water. Therefore, when golf ball 101 enters body of water 131 golf ball 101 sinks to the bottom. FIG. 4 illustrates this effect.

FIG. 4 also illustrates the initial state of cavity 103. Cavity 103 may be filled with a plurality of composites 121 and air. Each composite 121 may have dimensions larger than conduit diameter D, which prevents composite 121 from moving through conduit 105. The inability of the removable materials in cavity 103 to travel through conduit 105 allows the mass and density of golf ball 101 to remain constant.

When golf ball 101 submerges in water 133, the cavity 103 may not initially fill with water 133. Cavity 103 may be configured to delay the entry of water. For example, conduit 105 may have a diameter D small enough that the exchange of air from within cavity 103 and water 133 from the exterior of golf ball 101 may take a predetermined length of time. For example, the process may take several hours, several days, or even several weeks. Alternately, as will be discussed in later embodiments, cavity 103 may include a plug preventing water 133 from entering the cavity 103.

Figure 5:
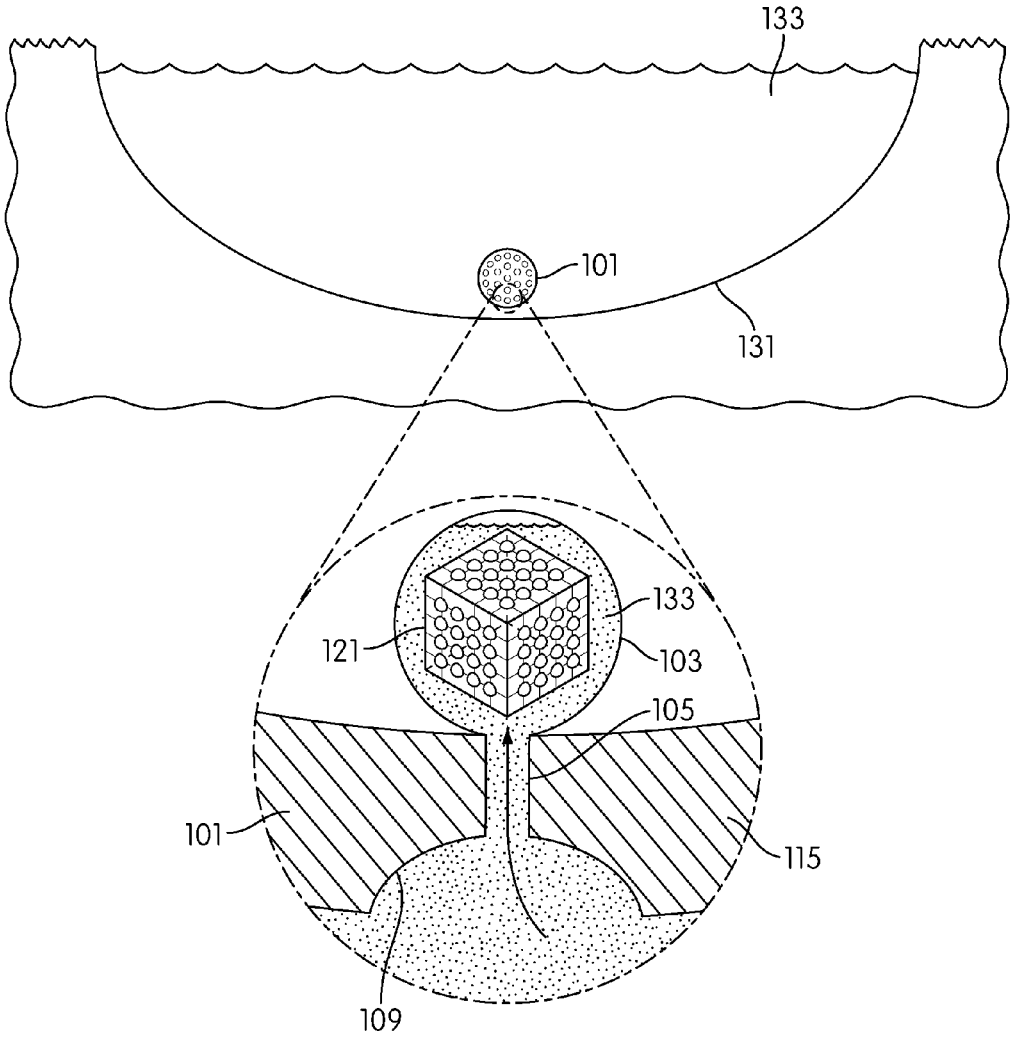
FIG. 5 shows a cavity of a golf ball after submersion in a water hazard for a first period of time.

As golf ball 101 stays submerged in water 133 for a period of time, cavity 103 may begin filling with water 133. FIG. 5 illustrates this effect. Cavity 103 may be configured to allow water to fill cavity 103 after a predetermined period of time.

Once water 133 has filled cavity 103, the water 133 may begin to dissolve the water-soluble second material 125. As second material 125 dissolves, the structural integrity of composite 121 may fail. Over time, composite 121 may be completely dissolved, leaving only unbound first material particles 123. In some embodiments, portions of first material particles 123 are freed from composite 121 over time. This may act as a second time delay for allowing golf ball 101 to float, as the buoyancy of golf ball 101 will shift from negative through neutral to positive only when a predetermined number or amount of first material particles 123 are unbound and travel through conduit 105 to the environment surrounding golf ball 101. In the embodiment shown in FIG. 5, the environment comprises water 133.

Figure 6:
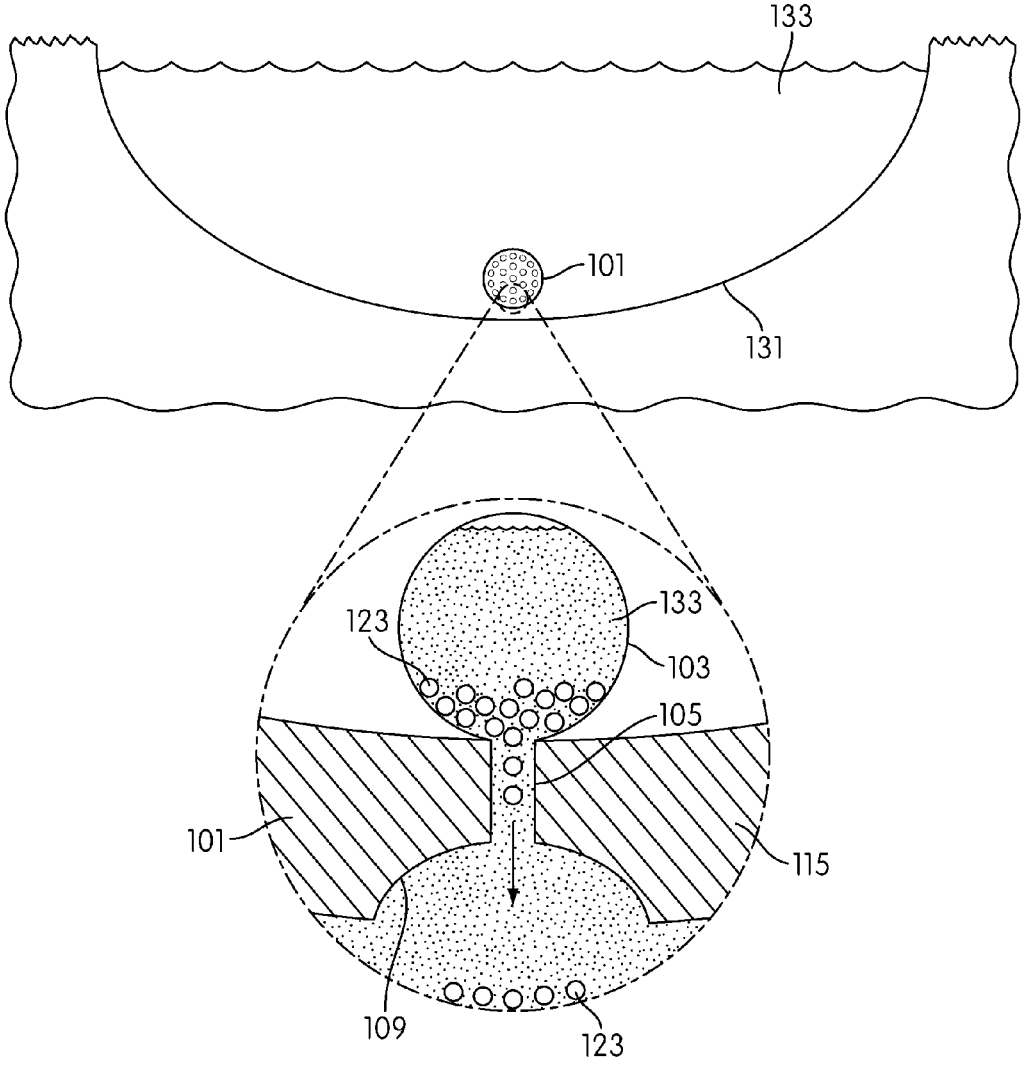
FIG. 6 shows a cavity of a golf ball after submersion in a water hazard for a second period of time.

FIG. 6 shows cavity 103 after composite 121 has dissolved completely. First material particles 123 may float freely within cavity 103. First material particles 123 are smaller than the conduit diameter D. Thus, as shown in FIG. 6, first material particles may exit cavity 103 through conduit 105. As discussed above, this process does not require composite 121 to completely dissolve. A predetermined portion of composite 121 may dissolve to allow a sufficient amount of first material particles to flow out of golf ball 101 through conduit 105 to allow the buoyancy of golf ball 101 to shift from negative to positive.

This dissolving process may take a predetermined length of time to occur. The length of time is determined by factors including the particular substance or material to be dissolved, the exposed surface area of the substance or material to be dissolved, the movement of the water (since rapidly moving water is likely to dissolve the substance or material faster than still water), the temperature of the water (since warmer water is likely to dissolve the substance faster than cooler water), the age of the ball, and the like. The length of time for the dissolving process to occur may range from minutes to hours to days to weeks or even months or years.

First material particles 123 have a density greater than water 133. Thus, first material particles 123 may fall to the bottom of body of water 131. Gravity may aid in drawing first material particles 123 out of cavity 103. In some embodiments, bubbling particles in composite 121 may assist in expelling first material particles 123 from cavity 103, particularly if cavity 103 and conduit 105 are not oriented toward the bottom of body of water 131.

Each first material particle 123 that exits cavity 103 may lower a total mass of golf ball 101 from the initial mass to a new lower mass. This will lower the density of golf ball 101 from the initial density. When a sufficient amount of first material particles 123 have exited cavity 103 and flowed to the environment surrounding golf ball 101 through conduit 105, the density of golf ball 101 may fall below the density of water 133.

Figure 7:
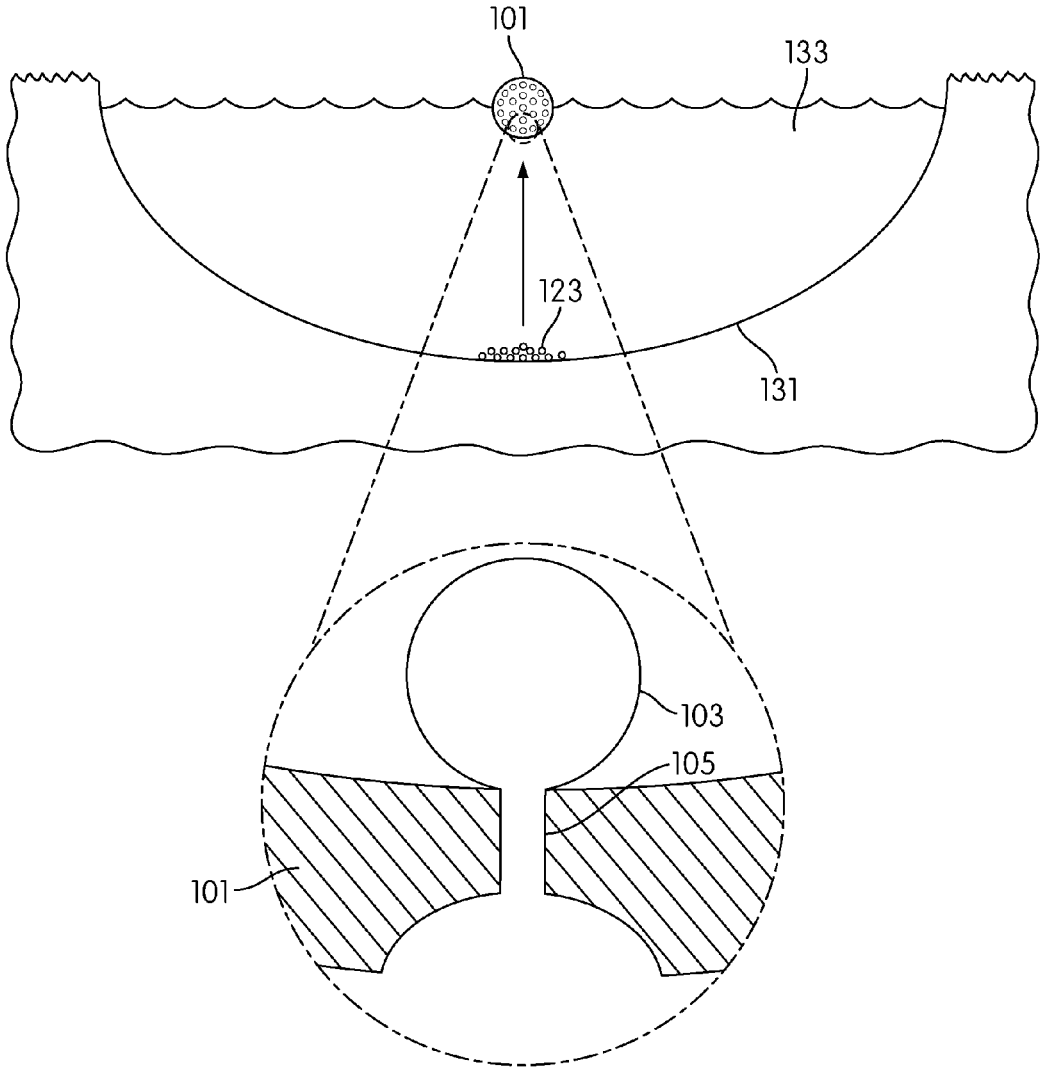
FIG. 7 shows a cavity of a golf ball floating on the surface of a water hazard after submersion of the golf ball in the water hazard for a prolonged period of time.

FIG. 7 shows the effect that the change in mass has on golf ball 101. When the density of golf ball 101 falls below the density of water 133, golf ball 101 may float to the surface of body of water 131. Golf ball 101 may be more easily retrieved from body of water 131 in this state.

Figure 8:
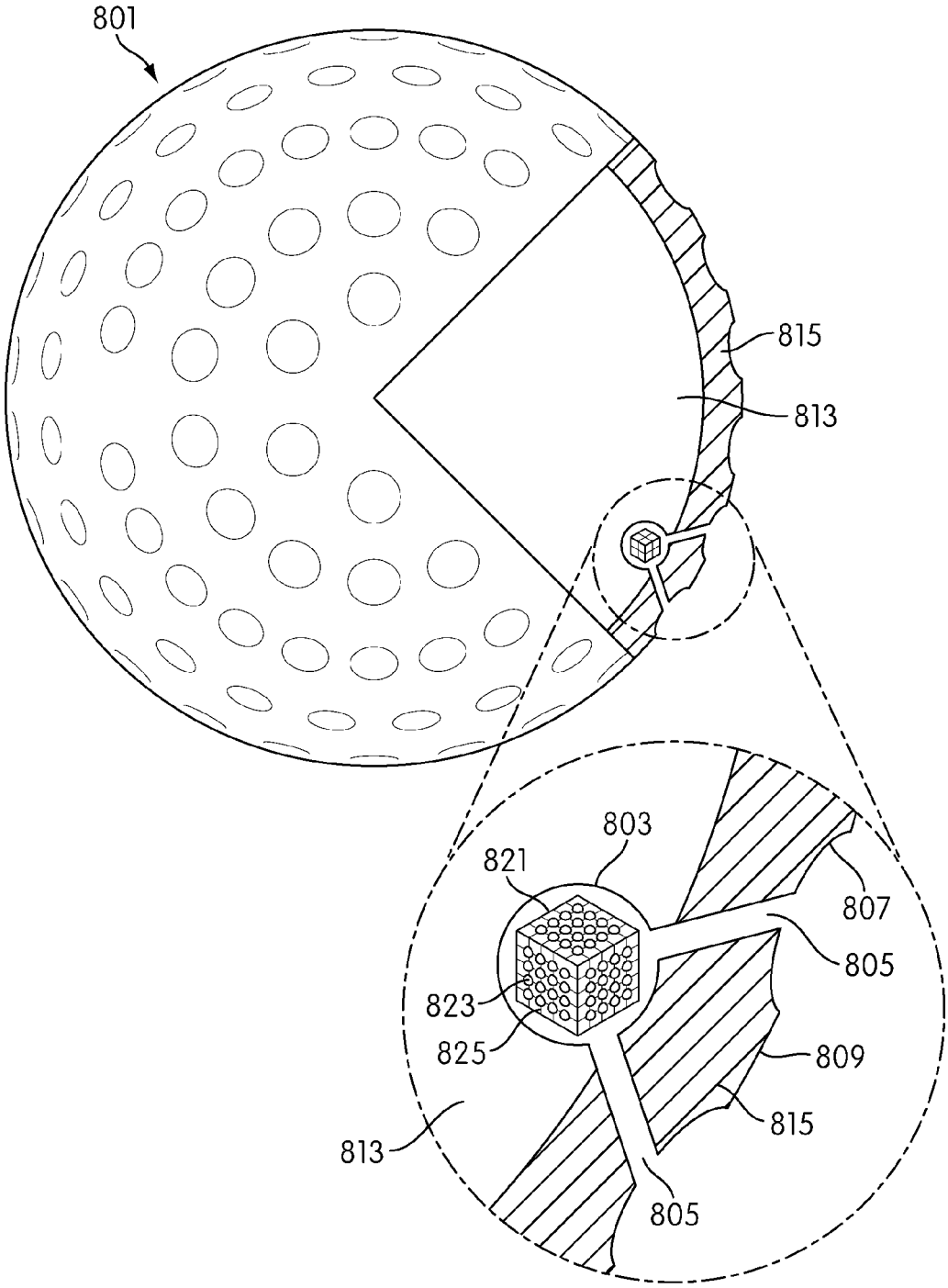
FIG. 8 is an exploded core view of an embodiment of a golf ball including a cavity having multiple conduits.

FIG. 8 shows another embodiment of a golf ball 801. FIG. 8 shows a cross-sectional view of one-quarter of an embodiment of golf ball 801. Golf ball 801 is similar to golf ball 101 in most respects. However, in this embodiment, cavity 803 may include two or more conduits 805 connecting cavity 803 an outermost surface of golf ball 801. An aperture or mouth of conduit 805 may be formed in or through the outermost surface of golf ball 801. In other words, conduit 805 provides a bore from cavity 803 to the outermost surface of golf ball 801 so that the aperture or mouth of conduit 805 can control the ingress and egress of material into and out of cavity 803. The number of conduits 805, though shown as two in FIG. 8 may be chosen based on desired flow properties out of cavity 803.

Using multiple conduits 805 may alter the flow of materials in and out of cavity 803. For example, using multiple conduits 805 into each cavity 803 may improve the flow of water into cavity 803 when golf ball 801 is submerged. For example, one conduit 805 may allow any air within cavity 803 to escape while water is drawn into cavity 803 via a different conduit 805.

A plurality of composites 821 may be located within cavity 803. Composites 821 may comprise a plurality of particles of a first material 823 bound together by a water-soluble second material 825. Composite 821 may have dimensions larger than the dimensions of any conduit 805. First material particles 823 may have dimensions smaller than the dimensions of each conduit 805. When submerged in water, golf ball 801 may behave in a similar fashion to the embodiment discussed in regard to FIGS. 4-7.

Conduits 805 may be positioned to aid in the process of allowing first material particles 823 to exit cavity 803. For example, by orienting multiple conduits 805 so that each conduit 805 extends away from cavity 803 at a different angle, at least one conduit 805 may be oriented to allow gravity to pull down first material particles 823 from cavity 803. FIG. 8 helps illustrate the effect multiple conduits 805 at multiple angles may have on the flow of first material particles 823. As shown in FIG. 8, cavity 803 is not oriented at a lowest point of golf ball 801, with respect to the orientation of the page. Yet one of the two conduits 805 illustrated in FIG. 8 forms a path in a substantially downward direction. Thus, gravity may pull first material particles 823 from cavity 803 if golf ball 801 were resting in the illustrated position. Using multiple conduits 805 may therefore aid in the process of allowing first material particles 823 to exit cavity 803.

Figure 9:
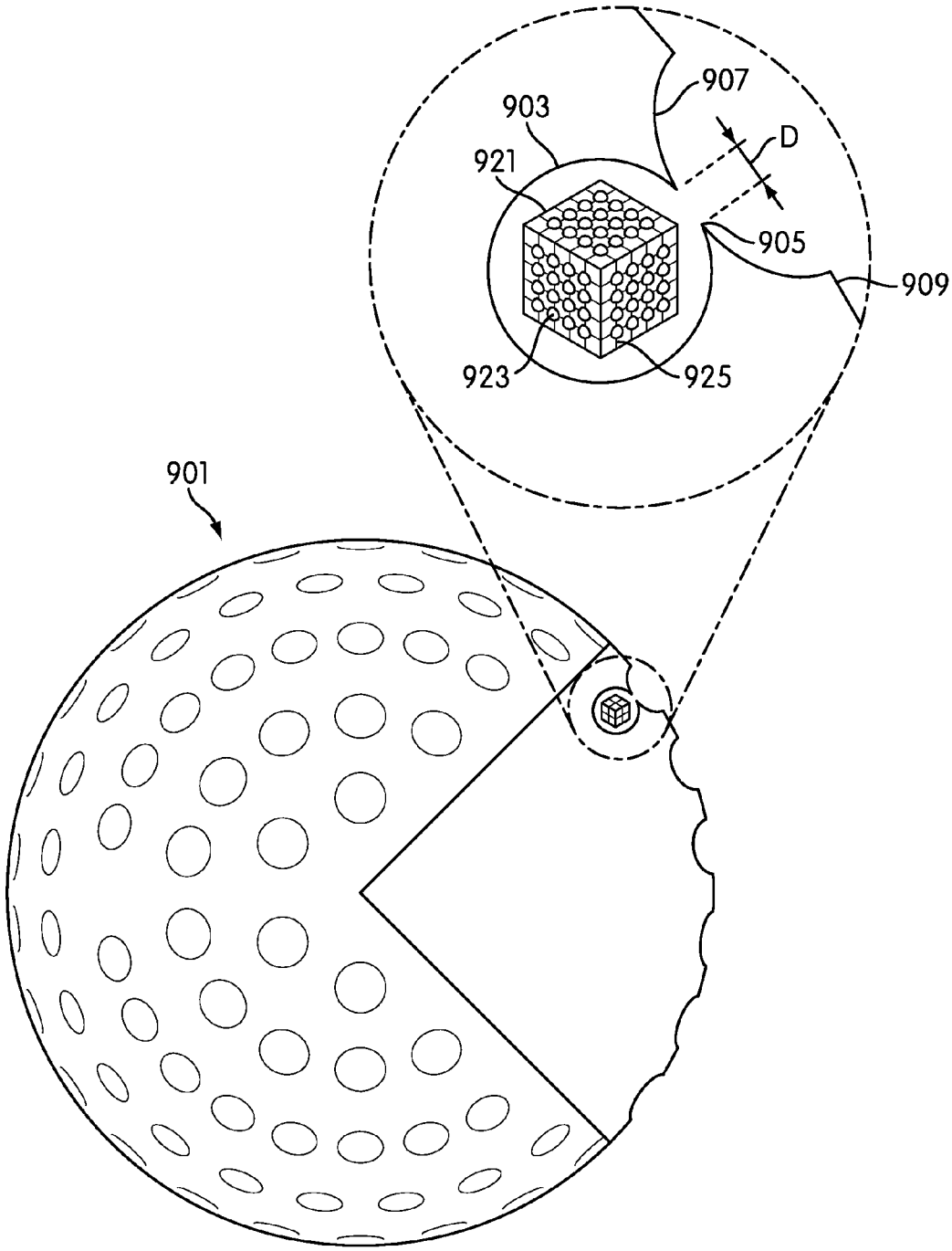
FIG. 9 is an exploded core view of an embodiment of a golf ball including a cavity.

FIG. 9 shows another embodiment of a golf ball 901. Golf ball 901 is similar in most respects to golf ball 101 and golf ball 801 described above, including having a cavity 903 associated with an outermost surface of golf ball 901 by a conduit 905.

Cavity 903 may be filled with one or more composites 921. Each composite 921 may include a plurality of particles of a first material 923 bound together by a water-soluble second material 925. Composite 921 may have dimensions larger than the dimensions of conduit 905. First material particles 923 may have dimensions smaller than the dimensions of each conduit 905. When submerged in water, golf ball 901 may behave in a similar fashion to the embodiment discussed in regard to FIGS. 4-7.

Figure 10:
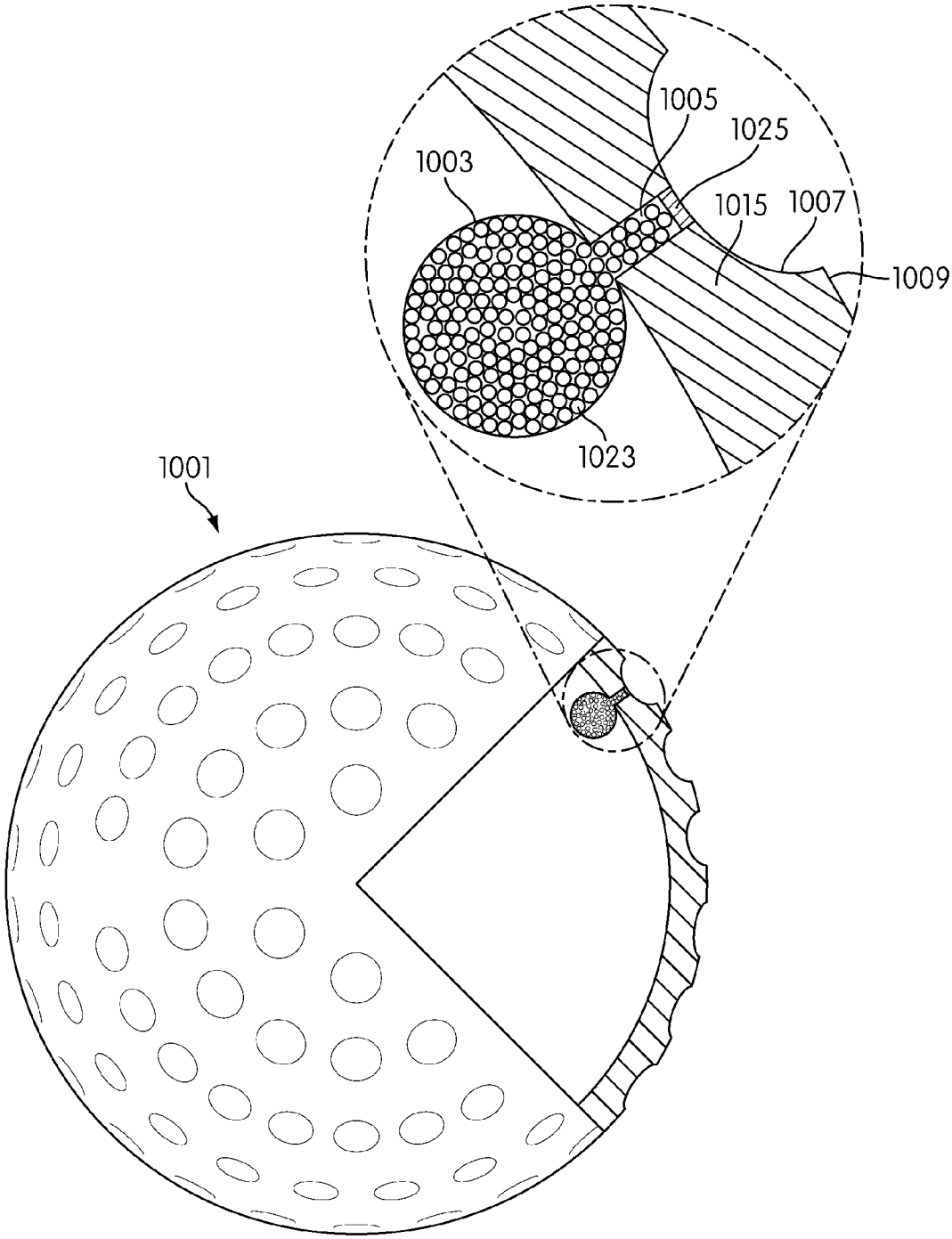
FIG. 10 is an exploded core view of an embodiment of a golf ball including a cavity blocked by a plug.

FIG. 10 shows a cross-sectional view of one-quarter of another embodiment of a golf ball 1001. Golf ball 1001 is similar in most respects to golf ball 101, golf ball 801, and golf ball 901, discussed above. In particular, golf ball 1001 may also include one or move cavities 1003 associated with an outermost surface of golf ball 1001 by a conduit 1005.

In the embodiment shown in FIG. 10, cavity 1003 may be filled with a plurality of pellets of a first material 1023. First material 1023 may comprise any material having a density greater than water. First material pellets 1023 may be of any shape or configuration. As shown in FIG. 10 first material pellets 1023 are spherical pellets. However, in other embodiments, first material pellets 1023 may have any size or shape, including powders, nanoparticles, nanotubes, or the like. Each first material pellet 1023 has a maximum dimension, such as a diameter, length, or width, which is smaller than a minimum dimension of conduit 1005, such as a conduit diameter, a conduit length, or a conduit width.

In some embodiments, cavity 1003 may be completely packed with first material pellets 1023. Cavity 1003 may be packed tightly enough to prevent first material pellets 1023 from moving or shifting during use of golf ball 1001. Preventing movement of first material pellets 1023 within cavity 1003 may prevent flight properties of golf ball 1001 from altering during use. In other embodiments, cavity 1003 may be loosely filled or only partially filled with first material pellets 1023.

First material pellets 1023 provide mass within golf ball 1001. When first material pellets 1023 are placed in cavity 1003, a mass of golf ball 1001 is increased. The mass of golf ball 1001 may be changed by the addition and removal of first material pellets 1023 from cavity 1003.

Conduit 1005 may include a plug 1025 formed of a second material. Plug 1025 may prevent any material, such as first material pellets 1023 or dirt particles from exiting or entering cavity 1003. The mass of golf ball 1001 may remain substantially constant while plug 1025 is in place.

The second material may be a water-soluble material. The second material may be a water-soluble epoxy or any of the water soluble materials discussed herein. When exposed to water for a predetermined period of time, second material dissolves. Therefore, when golf ball 1001 is submerged for significant periods of time, plug 1025 dissolves and no longer secures access to cavity 1003.

If plug 1025 dissolves, first material pellets 1023 may exit cavity 1003. The loss of first material pellets changes the mass and density of golf ball 1001. Golf ball 1001 may have an initial state having an initial mass and an initial density. The initial density of golf ball 1001 may be greater than water so that golf ball 1001 is negatively buoyant in water. If plug 1025 dissolves and a sufficient number of first material pellets 1023 exit cavity 1003, golf ball 1001 may reach a second density that is less than water so that golf ball 1001 is positively buoyant in water. Golf ball 1001 may then float.

The embodiments described above are used for illustrative purposes. Other systems, methods, features and advantages will be, or will become, apparent to one of ordinary skill in the art upon examination of the figures and detailed description. It is intended that all such additional systems, methods features and advantages be included within this description and this summary, be within the scope of the invention, and be protected by the following claims.

What is claimed is:

1. A golf ball comprising:
an inner layer;
a cover layer;
a cavity, the cavity including a conduit connecting the cavity with an exterior of the golf ball; and
the cavity contains a composite comprising particles of a first material and a second material, the first material having a density greater than water and the second material being water soluble.

2. The golf ball according to claim 1,
wherein the conduit has a conduit diameter,
wherein the dimensions of the composite are larger than the conduit diameter, and
wherein the dimensions of each first material particle are smaller than the conduit diameter so that any first material particle may pass through the conduit.

3. The golf ball according to claim 1,
wherein the cavity is configured to allow water to enter the cavity when the golf ball is submerged in water, and
wherein the second material is configured to dissolve after being immersed in water for longer than a predetermined period of time.

4. The golf ball according to claim 1,
wherein the second material is configured to dissolve when immersed in water to yield unbound first material particles, and
the cavity is configured to allow the unbound first material particles to exit the cavity.

5. The golf ball according to claim 1, wherein the cavity includes at least two conduits.

6. The golf ball according to claim 5, wherein each conduit is oriented at a different angle.

7. The golf ball according to claim 1, wherein the composite completely fills the cavity.

8. A golf ball comprising:
a layer defining an outermost surface of the golf ball;
a cavity disposed beneath the outermost surface of the golf ball;
a channel connecting the cavity with the outermost surface of the golf ball;
an aperture formed in the outermost surface, wherein the aperture is configured to control access to the channel;
a piece of a first material disposed in the cavity; and
a plug disposed in the channel, wherein the plug is configured to secure the piece of the first material in the cavity,
wherein the plug is made of a water soluble material.

9. The golf ball according to claim 8,
wherein the channel has a channel diameter, and
wherein the piece of the first material has a piece length, wherein the piece length is the largest dimension of the piece of the first material, and
wherein the piece length is smaller than the channel diameter.

10. The golf ball according to claim 8,
wherein the plug is configured to dissolve when the golf ball is immersed in water for longer than a predetermined period of time.

11. The golf ball according to claim 8, further comprising an additional channel.

12. The golf ball according to claim 11, wherein each channel extends away from the cavity at a different angle.

13. The golf ball according to claim 8, wherein the plug is disposed proximate the aperture.

14. A golf ball comprising:
a layer defining an outermost surface of the golf ball;
a chamber extending from an opening in the layer into an inner portion of the golf ball;
wherein the chamber contains a composite comprised of particles of a first material bound together by a second material, wherein the first material is denser than water, and wherein the second material is water soluble;
wherein the golf ball has an initial mass; and
wherein the golf ball is configured to transition to a second mass when submerged in water.

15. The golf ball according to claim 14, wherein the golf ball transitions to the second mass by releasing a material contained in the chamber after the golf ball has been submerged in water for longer than the predetermined period of time.

16. The golf ball according to claim 14,
wherein the golf ball has a negative buoyancy in water when the golf ball has the initial mass, and
wherein the golf ball has a positive buoyancy in water after the golf ball has transitioned to the second mass.

17. The golf ball according to claim 14, wherein the composite is larger than the opening in the cover layer and the first material particles are smaller than the opening in the cover layer.

18. The golf ball according to claim 14, wherein:
the chamber contains a plurality of particles of a first material; and
a plug is disposed in the opening in the layer,
wherein the first material is denser than water, and
wherein the plug is formed from a water-soluble second material.

19. The golf ball according to claim 18, wherein the plug is configured to dissolve after being submerged in water for the predetermined period of time so that at least a portion of the plurality of particle of the first material exit the chamber.

* * * * *